United States Patent [19]

Youngworth

[11] Patent Number: 4,497,182

[45] Date of Patent: Feb. 5, 1985

[54] DEHUMIDIFIER

[75] Inventor: Thomas H. Youngworth, North Quincy, Mass.

[73] Assignee: Benson Engineering & Mfg., Inc., Quincy, Mass.

[21] Appl. No.: 424,523

[22] Filed: Sep. 27, 1982

[51] Int. Cl.[3] ..... F25D 21/06

[52] U.S. Cl. ..... 62/151; 62/93; 62/201; 62/276; 62/439

[58] Field of Search ..... 62/201, 93, 92, 285, 62/291, 430, 438, 439, 351, 356, 430, 275, 276, 176.1, 176.2, 176.3, 176.5, 176.6; 236/44 R, 44 A, 44 C; 55/257 HE, 268; 34/74, 77

[56] References Cited

U.S. PATENT DOCUMENTS

| | | | |
|---|---|---|---|
| Re. 22,058 | 4/1942 | Brace | 62/201 |
| 910,525 | 1/1909 | Gardner | 62/92 |
| 2,164,223 | 6/1939 | Rodman | 62/93 |
| 2,170,993 | 8/1939 | Grady | 62/93 X |
| 2,250,386 | 7/1941 | Maniscalco | 62/439 X |
| 2,519,028 | 8/1950 | Dodge | 62/93 X |
| 2,621,899 | 12/1952 | Larson | 62/275 X |
| 2,627,669 | 2/1953 | Candor | 62/285 X |
| 2,726,515 | 12/1955 | Kleist | 62/439 X |
| 2,777,300 | 1/1957 | Palmer | 62/276 |
| 2,783,616 | 3/1957 | Dodge | 62/93 X |
| 3,020,730 | 2/1962 | Harris, Sr. | 62/351 X |
| 3,122,893 | 3/1964 | Millman | 62/93 |
| 3,541,807 | 11/1970 | Henderson | 62/272 |
| 3,575,009 | 4/1971 | Kooney | 62/272 |
| 3,740,959 | 6/1973 | Foss | 62/3 |
| 3,760,601 | 9/1973 | Bunten | 62/240 |
| 3,890,797 | 6/1975 | Brown | 62/91 |
| 4,193,443 | 3/1980 | Nanaumi et al. | 165/66 |

OTHER PUBLICATIONS

*Control for Small or Medium Sized Cooling System,* Bulletin No. 83-B, Detroit Lubricator Company, Detroit, Michigan, Jun. 15, 1938.

*Primary Examiner*—Harry B. Tanner

*Attorney, Agent, or Firm*—Morse, Altman & Dacey

[57] ABSTRACT

A dehumidifier for converting warm moist air to dry cool air. The dehumidifier includes a fan for delivering warm moist air to a plenum chamber, a dehumidifier chamber mounted adjacent to and communicating with the plenum chamber and provided with a condensing surface, a device for supplying a refrigerant to the dehumidifier chamber, and a structure for supplying short bursts of heat to the condensing surface. The condensing surface can be tapered or straight lengthwise and can be of any cross-sectional shape. Further, the condensing surface can comprise a plurality of air passages, again tapered or straight and of any cross-sectional shape.

3 Claims, 2 Drawing Figures

DEHUMIDIFIER

BACKGROUND OF THE INVENTION

1. Field of the Invention

The present invention relates generally to dehumidifiers and, more particularly, to a low temperature dehumidifier for converting warm moist air to dry cool air.

2. The Prior Art

Humidifiers and dehumidifiers are well known in the art. Typically, a dehumidifier includes a housing having a fan to create an air flow, a catch basin within the housing and, means for cooling the flow of air to condense the moisture in the air flow for collection of moisture in the catch basin. Some old dehumidifiers are rather complex and probably inefficient. See, for example, U.S. Pat. No. 910,525 that issued to H. C. Gardner in 1909. A more recent one sequentially cools dry air in three distinct steps. See the U.S. Pat. No. 3,890,797 that was granted to T. R. Brown in 1975. Other known apparatus are of the special application type, such as the one for use in boats (U.S. Pat. No. 3,760,601, P. H. Bunten), or the one for use in combination with a water closet (U.S. Pat. No. 3,740,959, F. D. Foss). Still others find applications in industrial plants requiring large quantities of compressed air which must be completely dry. See U.S. Pat. Nos. 3,541,807 to J. H. Henderson and 4,193,443 to Nanaumi et al. All of these known devices appear to lack, among others, that most desirable combination of simplicity and efficiency. There is thus room for improvement.

SUMMARY OF THE INVENTION

It is a principal object of the present invention to overcome the above disadvantages by providing a dehumidifier for converting warm moist air to dry cool air.

More specifically, it is an object of the present invention to provide a low temperature dehumidifier for converting warm moist air to dry cool air comprising a plenum chamber, a fan for delivering warm moist air to the plenum chamber, a dehumidifier chamber mounted adjacent and communicating with the plenum chamber and provided with a condensing surface, a device for supplying a refrigerant to the dehumidifier chamber and, means for intermittently delivering short bursts of heat to the condensing surface. The condensing surface, disposed within the dehumidifier chamber, can be of any shape, tapered or straight, and also can comprise a single or a plurality of air passages of any shape, tapered or straight. Preferably, the dehumidifier chmamber includes means for maintaining the condensing surface below freezing. Preferably, the means for delivering the short bursts of heat to the condensing surface comprises a surface heater arranged about the condensing surface momentarily to raise its surface temperature above freezing.

Other and further objects of the present invention will in part be obvious and will in part appear hereinafter.

The invention accordingly comprises the dehumidifier of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
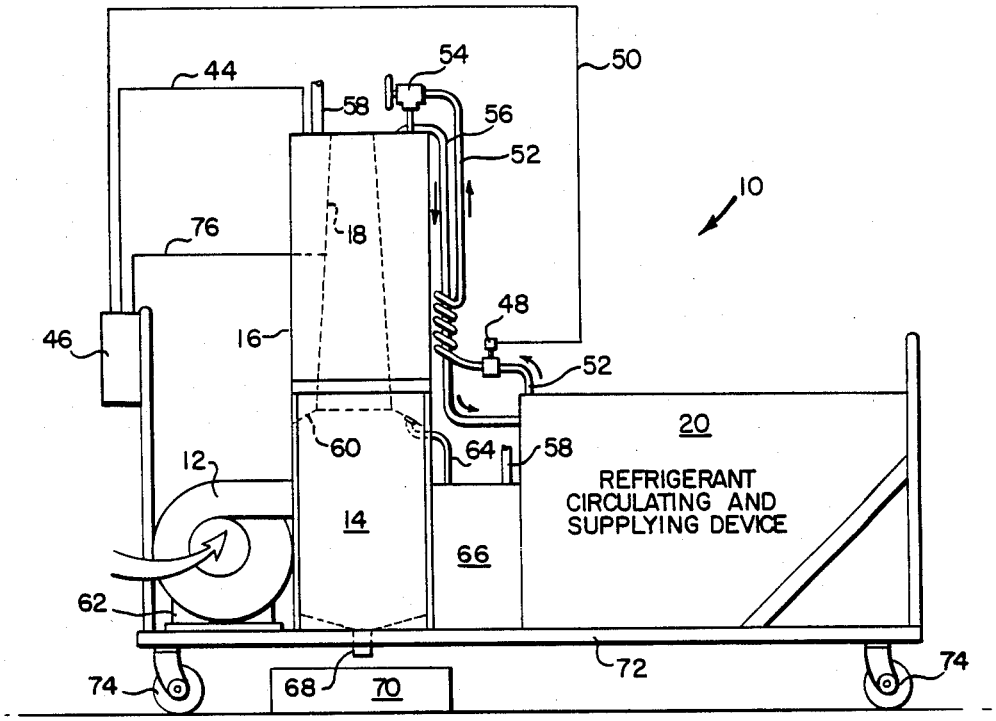
FIG. 1 is a side elevational schematic of a dehumidifier constructed in accordance with the present invention.

Generally, the illustrated embodiment of a low temperature dehumidifier 10 for converting warm moist air to dry cool air comprises a fan 12 for delivering warm moist air to a plenum chamber 14, a dehumidifier chamber 16 mounted adjacent to and communicating with the plenum chamber 14 and being provided with a condensing surface 18, a device 20 for supplying a refrigerant to the dehumidifier chamber 16, and means 22 for intermittently delivering short bursts of heat to the condensing surface 18. Preferably, the condensing surface 18 is defined by an air passage 24 disposed within the dehumidifier chamber 16. The condensing surface 18, i.e., the air passage 24, can be of any shape in cross section, such as round, square, oval, rectangular, triangular, star shape, tubular or any geometrical or polygon shape. Furthermore, the air passage 24 can be tapered, as shown, or straight, as a tube, Furthermore, there can be a plurality of passages defining the condensing surface, again of any shape and configuration, such as a plurality of tubes, tapered or straight, or other passages having round, square, oval, rectangular, triangular, star shape or any geometrical or polygon shape. Further, the condensing surface 18, i.e., the air passage or passages, can be disposed in any fashion within the dehumidifier chamber 16, whether it be centrally located as shown, or off to one side or the other.

Preferably, the condensing surface 18 is formed of a suitable metal, such as stainless steel. In the alternative, the condensing surface 18 also can be formed of a suitable plastic or a combination of metal and plastic. In either event, the condensing surface 18 must be a good heat conductor, be able to resist sudden temperature changes, be non-corrosive to fluids, such as water and certain chemicals, such as glycols and the like, and be of a material that holds up well under the temperature changes of the dehumidifier 10.

The device 20 for supplying a refrigerant to the dehumidifier chamber 16 can comprise any commercially available unit, such as, for example a C-line, air-cooled condensing unit R-502, Model No. C3AL-0202, manufactured by the Copeland Corporation of Sidney, Ohio. This particular unit features an evaporating temperature of −40° F., a suction pressure of about 11.0 inches of mercury vacuum, and a motor compression of about 4.3 pounds per square inch gauge pressure. The unit is rated for a capacity of about 6150 B.T.U. per hour at 90° F. ambient temperature, with 80° F. suction gas going into the compressor. Any other unit possessing like features and capacity can serve as the device 20 in the dehumidifier 10 of the invention. Further, any refrigerant recommended by the manufacturer of the particular unit selected for the device 20 can be employed, including ammonia, sulfur dioxide, ethyl or methyl chloride, any of the well-known flurocarbons, such as Freon, Ucon and Genetron, and Refrigerant 23 (fluoroform = $CHF_3$).

Figure 2:
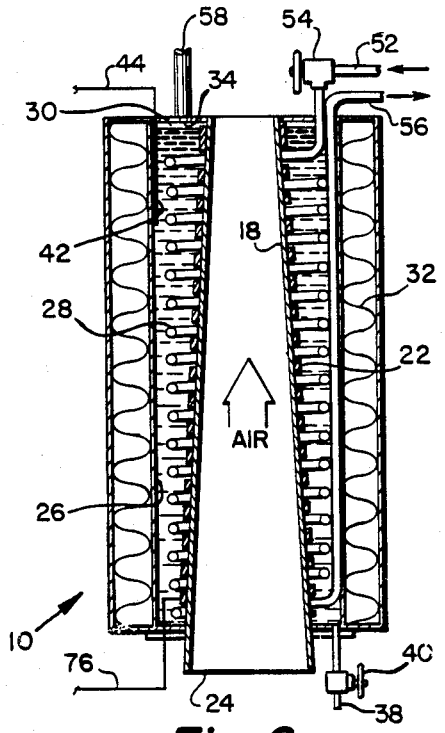
FIG. 2 is a vertical section of a part of the dehumidifier of FIG. 1.

As may be best observed in FIG. 2, the dehumidifier chamber 16 includes means for maintaining the condensing surface 18 below freezing, i.e., below 0° C. This means includes an enclosure 26, surrounding the condensing surface 18 or surfaces, if there is more than one air passage 24 in the dehumidifier 10, a cooling coil 28 disposed within the enclosure 26 and surrounding the condensing surface 18, a liquid coolant 30 contained within the enclosure 26 and surrounding the cooling coil 28, and insulating means 32 enveloping the enclosure 26. Preferably, the liquid coolant 30 is a suitable mixture of water and an antifreeze, such as ethylene glycol. It is important to keep the level of the liquid coolant 30 high within the enclosure 26 and just below the top of the air passage 24, substantially as shown. The liquid coolant 30 is admitted into the enclosure 26 via a suitable opening 34, and is drained therefrom via a drain pipe 38 provided with a drain valve 40. A temperature sensor 42, which may comprise any known temperature transducer, preferably is located in the enclosure 26 and submerged in the liquid coolant 30 so as to monitor its temperature.

The temperature sensor 42 is coupled via a line 44 to a temperature controller 46. The temperature controller 46 is, in turn, connected to a solenoid valve 48 via a line 50. The solenoid valve 48 is mounted in a refrigerant feed pipe 52 leading from the device 20 to the cooling coil 28 via an expansion valve 54. Initially, the refrigerant feed pipe 52 preferably encircles a portion of a refrigerant return pipe 56 so as to super heat the returning refrigerant before it reaches the device 20, to make sure that all droplets are removed so as to have a pure gas going into the device 20.

The lower end of the air passage 24 preferably reaches somewhat into the plenum chamber 14 and is provided there with a circumferential apron 60 to help direct the air flow into the air passage 24.

The fan 12 preferably is driven by a suitable electric motor 62 mounted next to the fan 12. Further, the drain pipe 38 preferably is connected, via a flexible hose 64, to either a receptacle 66 as shown, (which may be a two-chamber receptacle) or to a drain in the floor. Further, the plenum chamber 14 is provided with a drain pipe 68 of its own, communicating either with a suitable receptacle 70 or with a drain in the floor. Further, the dehumidifier 10 of the invention also functions as an air refrigeration unit. The dehumidifier 10 can be stationary or mounted on a suitable carriage 72 provided with a plurality of rollers 74.

In operation, the temperature of the liquid coolant 30, and thereby the condensing surface, is brought to or below freezing, i.e., 0° C. This is accomplished by the temperature sensor 42 transmitting the coolant's 30 temperature to the temperature controller 46, which in turn opens and closes the solenoid valve 48 to admit fresh refrigerant to the cooling coil 28. With the temperature of the condensing surface 18 at or below freezing, as desired, the electric motor 62 is switched on to operate the fan 12. The fan 12 thus begins to deliver warm moist air in the environment to the plenum chamber 14, and from there, into the lower end of the air passage 24. Air is then passed upward through the air passage 24 and contacts the condensing surface 18. When the condensing surface 18 is colder than the air, the air will be cooled as it passes upward, through and out of the air passage 24. When the condensing surface 18 is colder than the dew point of the warm moist air (as will be the case for most of the time), water vapor (i.e., moisture) in the air will begin to condense on the condensing surface 18. With the temperature of the condensing surface 18 being below freezing, the water vapor will not only condense but will solidify, forming ice on the condensing surface 18.

After a predetermined amount of ice and frost has formed on the surface 18 and the air flow through the passage 24 thus has diminished accordingly, the temperature controller 46, being also coupled to the heating means 22 via a lead 76, quickly and momentarily energizes the heating means 22. In the alternative, the heating means 22 also can be energized manually by actuating the appropriate switch on the controller 46. The energized heating means 22 will, in turn, deliver a short burst of heat to the condensing surface 18, quickly raising its surface temperature to above freezing. As a consequence, the ice that has solidified on the condensing surface 18 will be quickly released from the surface 18 and will drop out and away from the air passage 24 and into the bottom of the plenum chamber 14, whence it drains as water into the receptacle 70. As the ice drops into the plenum chamber 14, it also has the effect of cooling the air therein.

As mentioned, the heating means 22 may comprise an electric surface or a suitable heating coil or graphite cloth or any like means capable of delivering, intermittently on command, short bursts of heat to the condensing surface 18 so as to momentarily raise its surface temperature above freezing for the ice to break away.

In the alternative, the surface temperature of the condensing surface 18 can be raised above freezing by quickly draining the liquid coolant 30 from the enclosure 26, as by dumping it via the hose 64 into one chamber of the receptacle 66, and replacing it quickly with like, but warm liquid coolant 30 from the second chamber of the receptacle 66 via a hose 58. After the ice is released from the condensing surface 18, the process is reversed, with the warm coolant dumped via the hose 64, but this time into the warm chamber, and cold coolant reintroduced into the enclosure 26 via the hose 58. In this alternative arrangement, these operations preferably are effected automatically, namely the opening of the drain valve 40 and the pumping in of the replacement coolant 30 into the enclosure 26. Of course, this latter alternative of draining the coolant 30 also can be combined with employing the heating means 22. This results in the raising of the temperature of the condensing surface 18 to above freezing much more quickly than using only one or the other method. And the faster and higher is the temperature rise of the condensing surface 18, the quicker is the release of the ice build-up therefrom. It is further contemplated that, if desired, the dehumidifier 10 of the invention also can be employed as a combination ice maker as well by simply re-designing the plenum chamber 14 so that it stores and/or dispenses the ice as periodically released from the condensing surface 18.

Thus it has been shown and described a dehumidifier 10 designed for converting warm moist air to dry cool air, which dehumidifier 10 satisfies the objects and advantages set forth above.

Since certain changes may be made in the present disclosure without departing from the scope of the present invention, it is intended that all matter described in the foregoing specification or shown in the accompanying drawings, be interpreted as an illustrative and not in a limiting sense.

What is claimed is:

1. A dehumidifier comprising:

(a) a plenum chamber;

(b) a fan for delivering warm moist air to said plenum chamber;

(c) a dehumidifier chamber mounted adjacent and communicating with said plenum chamber and provided with a condensing surface, said condensing surface being defined by an upwardly tapered passage disposed within said dehumidifier chamber;

(d) a device for supplying a refrigerant to said dehumidifier chamber;

(e) said dehumidifier chamber including means for maintaining said condensing surface below freezing;

(f) means for intermittently delivering short bursts of heat to said condensing surface;

(g) said means for maintaining said condensing surface below freezing including an enclosure, a cooling coil disposed in said enclosure and about said condensing surface, said cooling coil communicating via a pipe with said device for supplying said refrigerant thereto, a cooling liquid contained within said enclosure and surrounding said cooling coil, a surface heater arranged about said condensing surface interspersed between the windings of said cooling coil, and insulating means enveloping said enclosure, a temperature control and, a temperature sensor disposed within said enclosure and in communication with said cooling liquid, said temperature sensor being coupled to said temperature control, a solenoid valve provided in said pipe for supplying said refrigerant to said cooling coil and coupled to said temperature control.

2. The dehumidifier of claim 1 wherein said enclosure is provided with a drain valve, and wherein said cooling coil is provided with an expansion valve.

3. The dehumidifier of claim 2 wherein said dehumidifier also functions as an air refrigeration unit and is mounted on a carriage, an electric motor secured to said carriage and operatively connected to drive said fan, and wherein said plenum chamber is provided with a drain pipe.

* * * * *